US010753162B2

(12) United States Patent
Vo

(10) Patent No.: US 10,753,162 B2
(45) Date of Patent: Aug. 25, 2020

(54) WRENCH ASSEMBLY WITH TUBULAR CENTERING DEVICE

(71) Applicant: FORUM US, INC, Houston, TX (US)

(72) Inventor: Han Vo, Cypress, TX (US)

(73) Assignee: FORUM US, INC., Houston, TX (US)

( * ) Notice: Subject to any disclaimer, the term of this patent is extended or adjusted under 35 U.S.C. 154(b) by 273 days.

(21) Appl. No.: 15/609,315

(22) Filed: May 31, 2017

(65) Prior Publication Data

US 2018/0347297 A1 Dec. 6, 2018

(51) Int. Cl.
*E21B 19/16* (2006.01)

(52) U.S. Cl.
CPC ..... *E21B 19/161* (2013.01); *E21B 19/163* (2013.01); *E21B 19/164* (2013.01)

(58) Field of Classification Search
CPC .... B23P 19/061; E21B 19/161; E21B 19/163; E21B 19/16; E21B 19/164; E21B 19/168; E21B 19/10; B21B 19/16; B21B 16/00; B21B 19/24; B25B 13/50; B25B 13/5008; B25B 13/5041
USPC ..... 81/57.19, 57.15, 57.16
See application file for complete search history.

(56) References Cited

U.S. PATENT DOCUMENTS

| | | | | |
|---|---|---|---|---|
| 4,403,666 | A | 9/1983 | Willis | |
| 5,054,550 | A | 10/1991 | Hodge | |
| 5,791,206 | A | 8/1998 | Daigle et al. | |
| 6,116,118 | A * | 9/2000 | Wesch, Jr. | E21B 19/161 81/57.16 |
| 8,474,806 | B2 | 7/2013 | Orgeron | |
| 2004/0051326 | A1* | 3/2004 | Belik | B25B 5/147 294/86.15 |
| 2005/0076744 | A1 | 4/2005 | Pietras et al. | |
| 2009/0211405 | A1* | 8/2009 | Hunter | E21B 19/163 81/57.16 |

OTHER PUBLICATIONS

International Search Report and Written Opinion dated Aug. 23, 2018, Corresponding to Application No. PCT/US2018/031964.

* cited by examiner

*Primary Examiner* — David B. Thomas
*Assistant Examiner* — Robert F Neibaur
(74) *Attorney, Agent, or Firm* — Patterson & Sheridan, L.L.P.

(57) ABSTRACT

A wrench assembly having an upper clamp assembly and a lower clamp assembly coupled to the upper clamp assembly, wherein the lower clamp assembly comprises a plurality of grippers each having a grip head configured to grip a tubular. Each grip head has a die plate surrounded by a primary contact plate. The primary contact plate is configured to contact the tubular prior to the die plate.

21 Claims, 8 Drawing Sheets

WRENCH ASSEMBLY WITH TUBULAR CENTERING DEVICE

BACKGROUND

Field

Embodiments disclosed herein relate to a wrench tool for coupling or de-coupling tubulars in a drilling or workover operation utilized in the oil and gas industry.

Description of the Related Art

A wrench tool (also known as a "tong") is commonly used in the oil and gas industry to rotate a tubular when making up or breaking out a threaded connection. The wrench tool rotates a tubular relative to another tubular to thread the tubulars together during a make-up operation, and rotates the tubular in an opposite direction to unthread the tubulars from each other during a break-out operation. A spinner tool may be used in conjunction with the wrench tool. The spinner tool is a relatively low torque, high speed device used for the initial makeup of a threaded connection, while the wrench tool is a relatively high torque, low speed device that is used subsequently to the spinner tool to provide a greater amount of torque to complete the threaded connection.

The wrench (also known as a "power tong") may be composed of upper and lower torque bodies having a plurality of grippers that are moved into contact with the tubulars. The upper torque body is configured to rotate one of the tubulars relative to the other tubular, which is held stationary by the lower torque body, to couple or decouple the tubulars. One problem that often occurs is the grippers grip the tubular in a position such that the center axis of the tubular is offset from the center axis of the wrench. This is caused when some of the grippers contact the tubular prior to the other grippers, which results in a misalignment of the wrench with the center axis of the tubular. The improper alignment between the wrench and the center axis of the tubular often results in a misapplication of the appropriate amount of torque to a threaded connection, thereby potentially resulting in a leak in the threaded connection.

Therefore, there exists a need for new and/or improved wrench tools.

SUMMARY

In one embodiment, a wrench assembly comprises an upper clamp assembly, and a lower clamp assembly coupled to the upper clamp assembly, wherein the lower clamp assembly comprises a plurality of grippers each having a grip head configured to grip a tubular, wherein each grip head has a die plate surrounded by a primary contact plate, wherein the primary contact plate is configured to contact the tubular prior to the die plate.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a wrench tool for making up and breaking out a threaded connection between two tubulars. The wrench tool is a relatively high torque, low speed device that is used to provide a greater amount of torque to complete a threaded connection or initially break-out a threaded connection between two tubulars. The wrench tool includes a wrench assembly having an upper clamp assembly and a lower clamp assembly.

During a make-up or break-out operation, the upper clamp assembly grips and rotates one tubular relative to another tubular, which is gripped and held stationary by the lower clamp assembly. The wrench assembly is used to apply a specified torque value to a threaded connection between two tubulars. The wrench assembly includes a tubular centering device configured to actuate a plurality of grippers of the lower clamp assembly into engagement with one tubular so that the tubular is centered and gripped in a position where the center axis of the tubular is aligned with the center axis of the wrench assembly.

Figure 1:
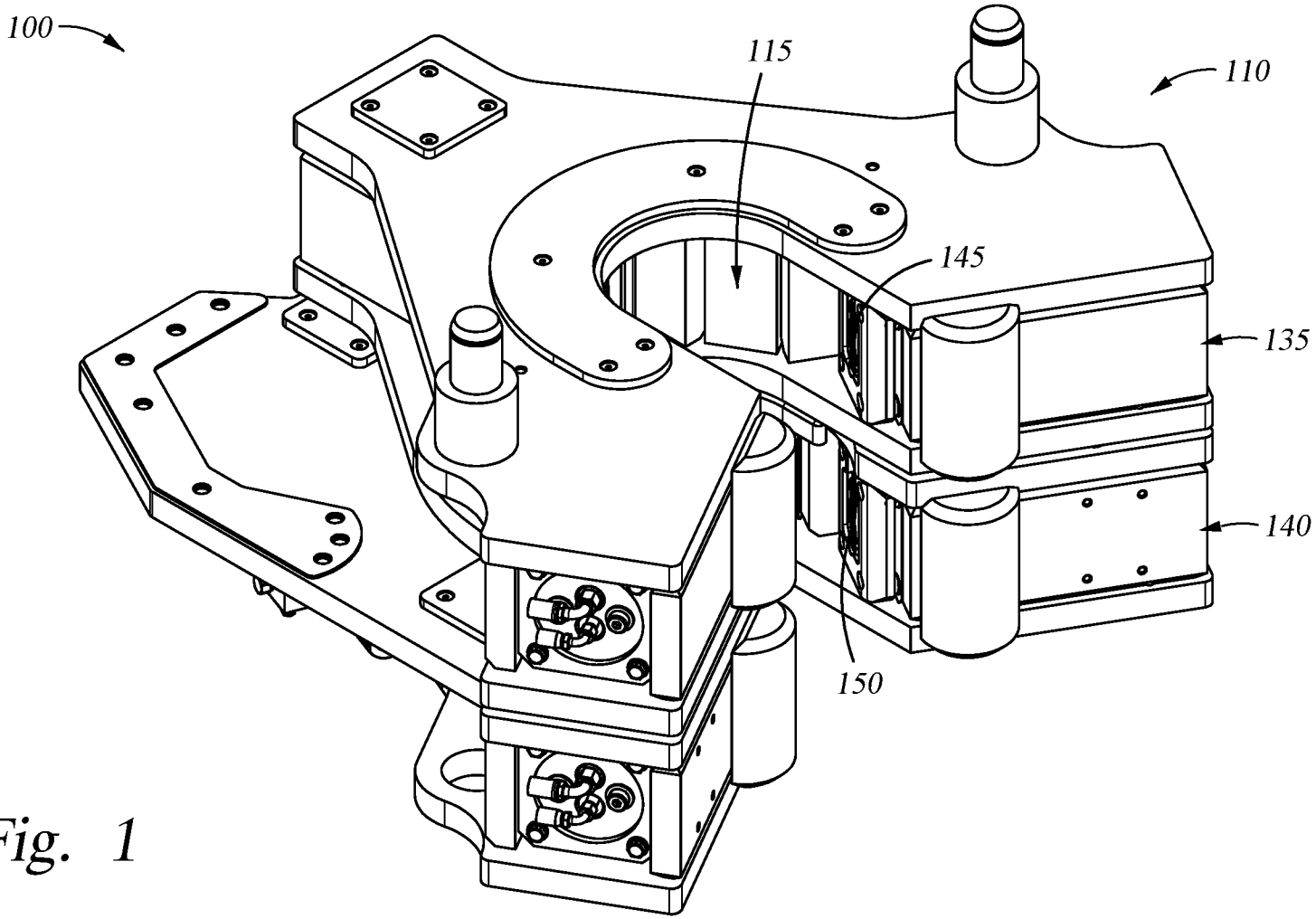
FIG. 1 is an isometric view of a wrench tool according to one embodiment.
Figure 2:
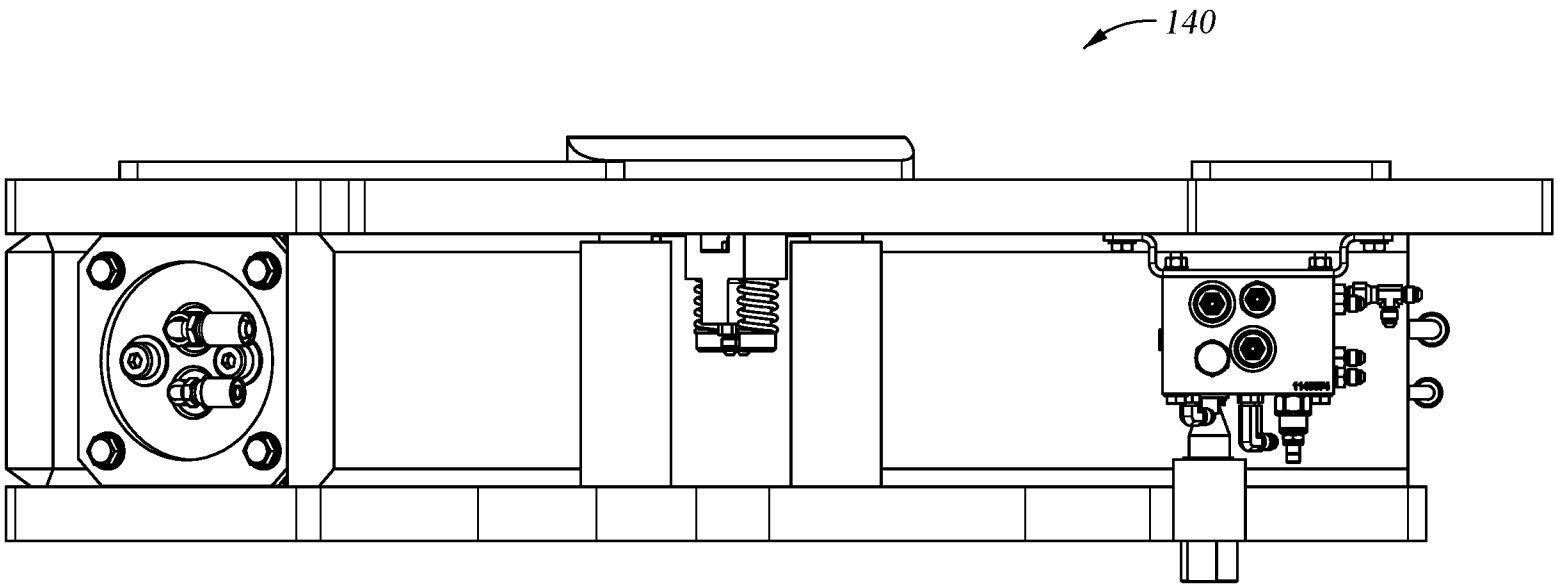
FIG. 2 is a side view of a lower clamp assembly of the wrench tool of FIG. 1.
Figure 3:
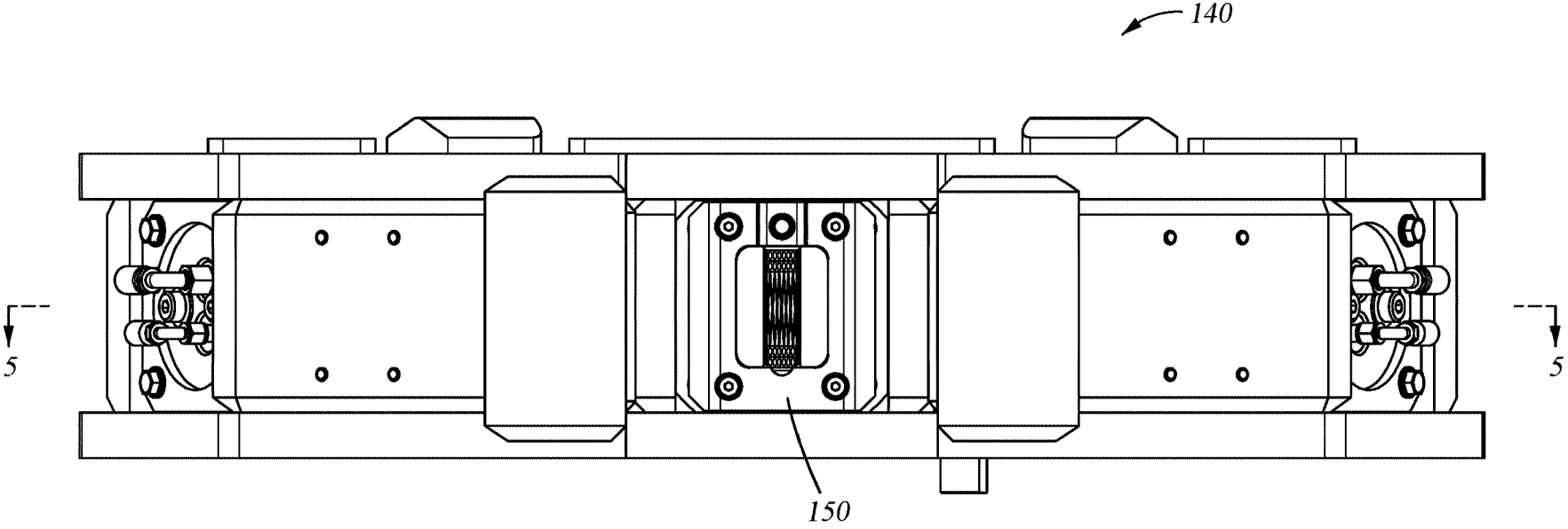
FIG. 3 is a front view of the lower clamp assembly.
Figure 4:
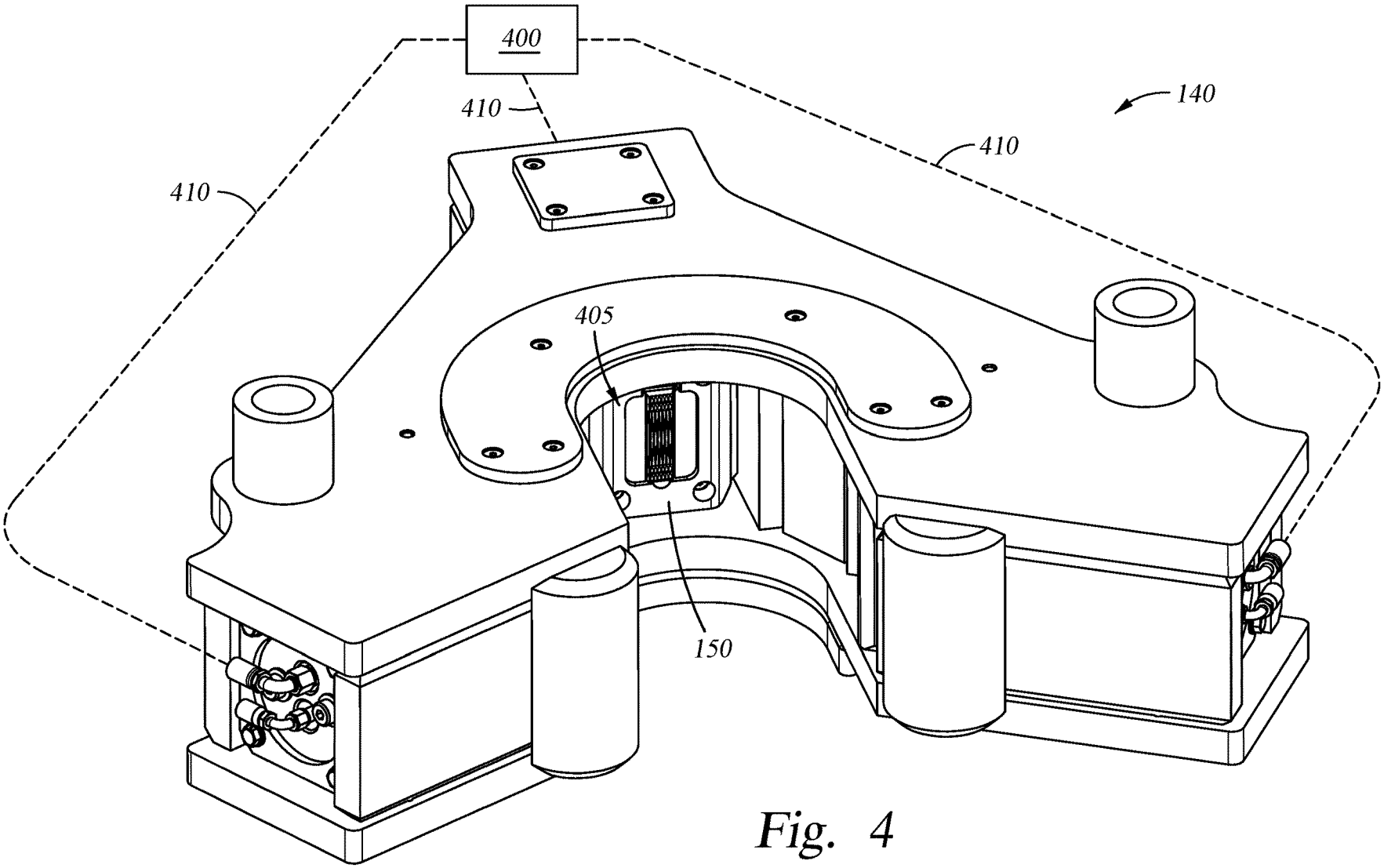
FIG. 4 is an isometric view of the lower clamp assembly.

FIGS. 1-4 are various views of one embodiment of a wrench tool 100. FIG. 1 is an isometric view of the wrench tool 100. FIG. 2 is a side view of a lower clamp assembly of the wrench tool 100. FIG. 3 is a front view of the lower clamp assembly of the wrench tool 100. FIG. 4 is an isometric view of the lower clamp assembly of the wrench tool 100.

The wrench tool 100 includes a wrench assembly 110 having an upper clamp assembly 135 and a lower clamp assembly 140. The upper clamp assembly 135 and the lower clamp assembly 140 include a plurality of grippers 145 and 150, respectively, some of which are shown in FIGS. 1 and 3. The grippers 150 of the lower clamp assembly 140 may be used to grip a box end of a first tubular, and the grippers 145 of the upper clamp assembly 135 may be used to grip a pin end of a second tubular.

In a make-up operation, the wrench tool 100 is brought into proximity with a first tubular that is held by a rotary spider on a rig floor for example. The grippers 150 of the lower clamp assembly 140 are actuated to grip the box end of the first tubular. A pin end of a second tubular is positioned on top of the box end of the first tubular by an elevator or top drive for example. The second tubular is rotated by a spinner tool (not shown) to initially make-up the threaded connection.

After the initial make-up by the spinner tool, the grippers 145 of the upper clamp assembly 135 are actuated into contact with the pin end of the second tubular, while the box end of the first tubular remains gripped by the lower clamp assembly 140. The upper clamp assembly 135 then is rotated relative to the lower clamp assembly 140 to further tighten the threads between the first and second tubulars.

However, one problem that often occurs with a conventional wrench assembly is that the grippers of the lower clamp assembly grip the box end of the first tubular in a position where the center axis of the first tubular is offset from the center axis of the wrench assembly 110. This may be caused when one of the grippers of the lower clamp assembly contact the first tubular prior to the other grippers of the lower clamp assembly, which results in a misalignment of the center axis of the wrench assembly 110 with the center axis of the first tubular.

To prevent or minimize any offset between the center axis of the wrench assembly 110 and the center axis of the first tubular, the grippers 150 of the lower clamp assembly 140 as described herein are configured to center the tubular within a central opening 115 of the wrench assembly 110.

Figure 5A:
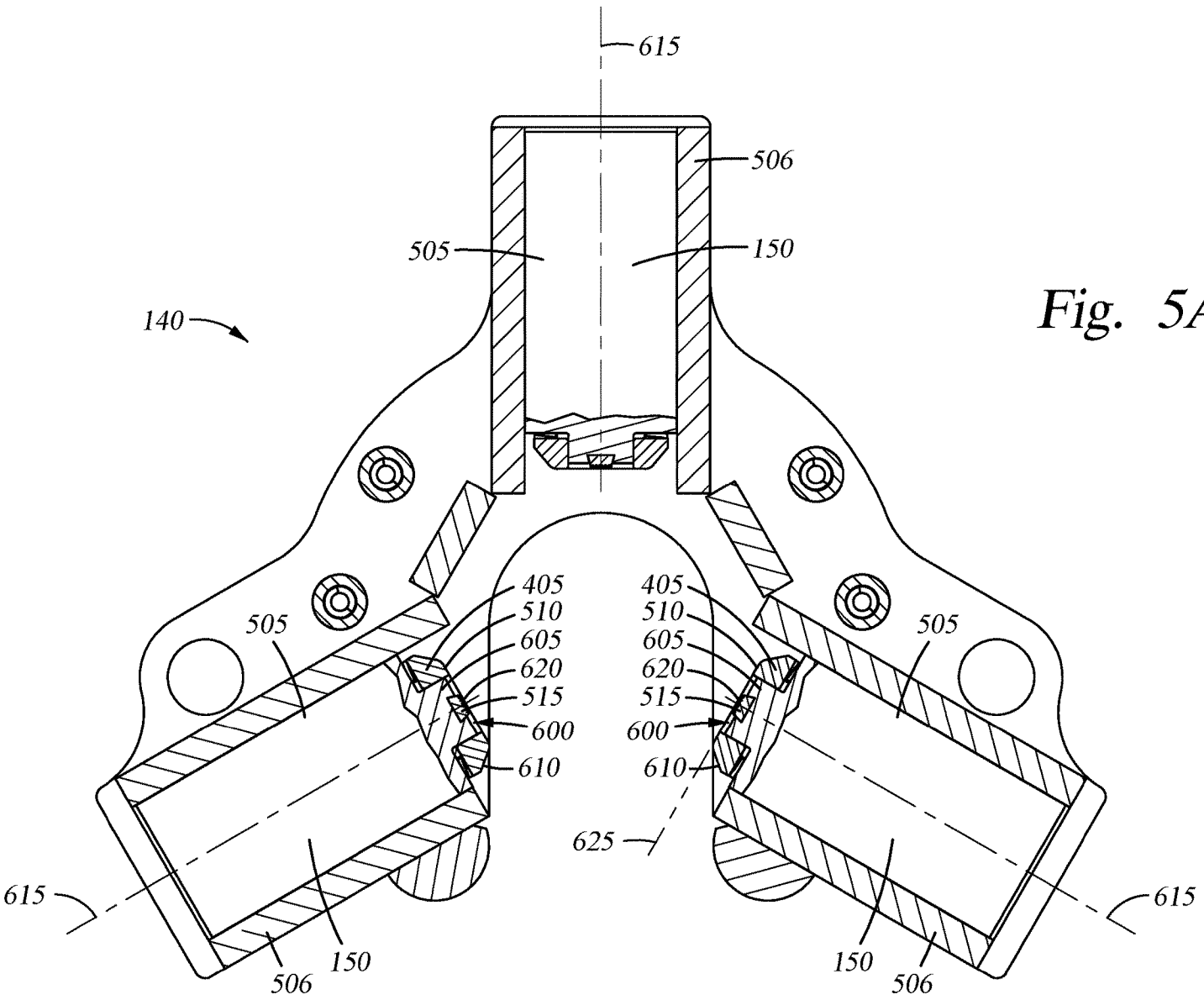
FIG. 5A is a sectional view of the lower clamp assembly taken along lines 5-5 of FIG. 3.
Figure 5B:
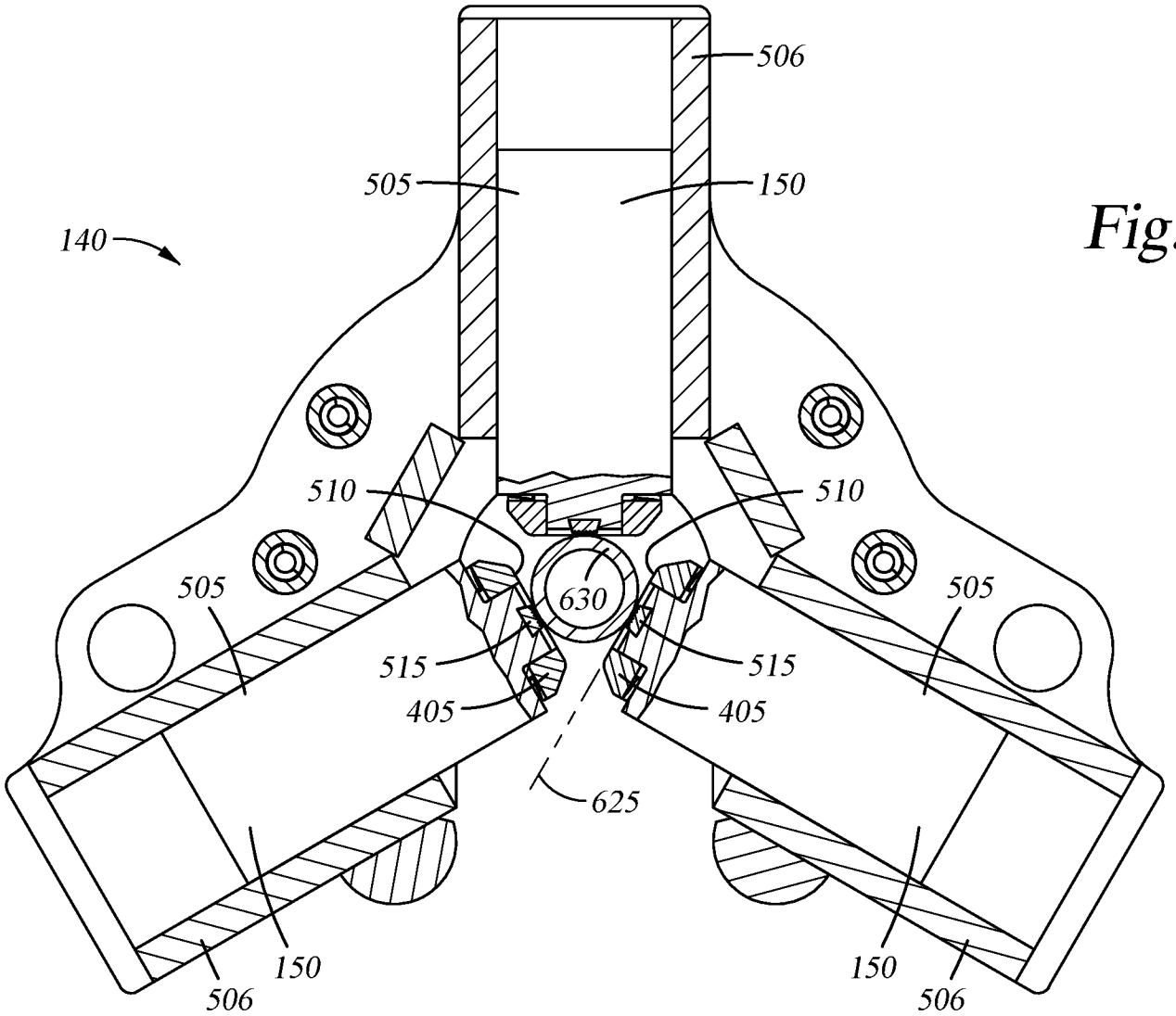
FIG. 5B is a sectional view of the lower clamp assembly showing grippers of the lower clamp assembly gripping a tubular.

FIGS. 5A and 5B are sectional views of the lower clamp assembly 140 along line 5-5 of FIG. 3. Each gripper 150 includes a piston 505 disposed within a housing 506, and a grip head 405 coupled to one end of the piston 505. The piston 505 is movable relative to the housing 506, such as by hydraulic fluid, to move the grip head 405 into and out of contact with the first tubular 630 (shown in FIG. 5B). The grip head 405 includes a primary contact plate 510 housing a die plate 515. The primary contact plate 510 is configured to contact the first tubular 630 prior to the die plate 515 to help center the first tubular 630 within the wrench assembly 110 before gripping.

Each of the grip heads 405 include a central cavity 600 where an extended member 605 (also shown in FIGS. 6A and 6B) of the piston 505, in which the die plate 515 is fixed, may be housed. Each of the primary contact plates 510 include rounded corners 610. The rounded corners 610 may be a bevel, a radius, or a chamfer. The rounded corners 610 help push the first tubular 630 toward the center of the lower clamp assembly 140.

The primary contact plates 510 are movable relative to the piston 505. For example, the primary contact plates 510 may move relative to the piston 505 along a longitudinal axis 615 of the grippers 150. In a first position, as shown in FIG. 5A, a gripping surface 620 of each of the die plates 515 is below a plane 625 of the primary contact plates 510. This allows the grip heads 405 to contact the first tubular 630 before the die plate 515 contact and grips the first tubular 630, which helps centering of the first tubular 630.

FIG. 5B shows the grippers 150 of the lower clamp assembly 140 gripping the first tubular 630. The primary contact plates 510 of each of the grip heads 405 are in a second position such that the die plates 515 extend beyond the plane 625 of the primary contact plates 510.

Figure 6A:
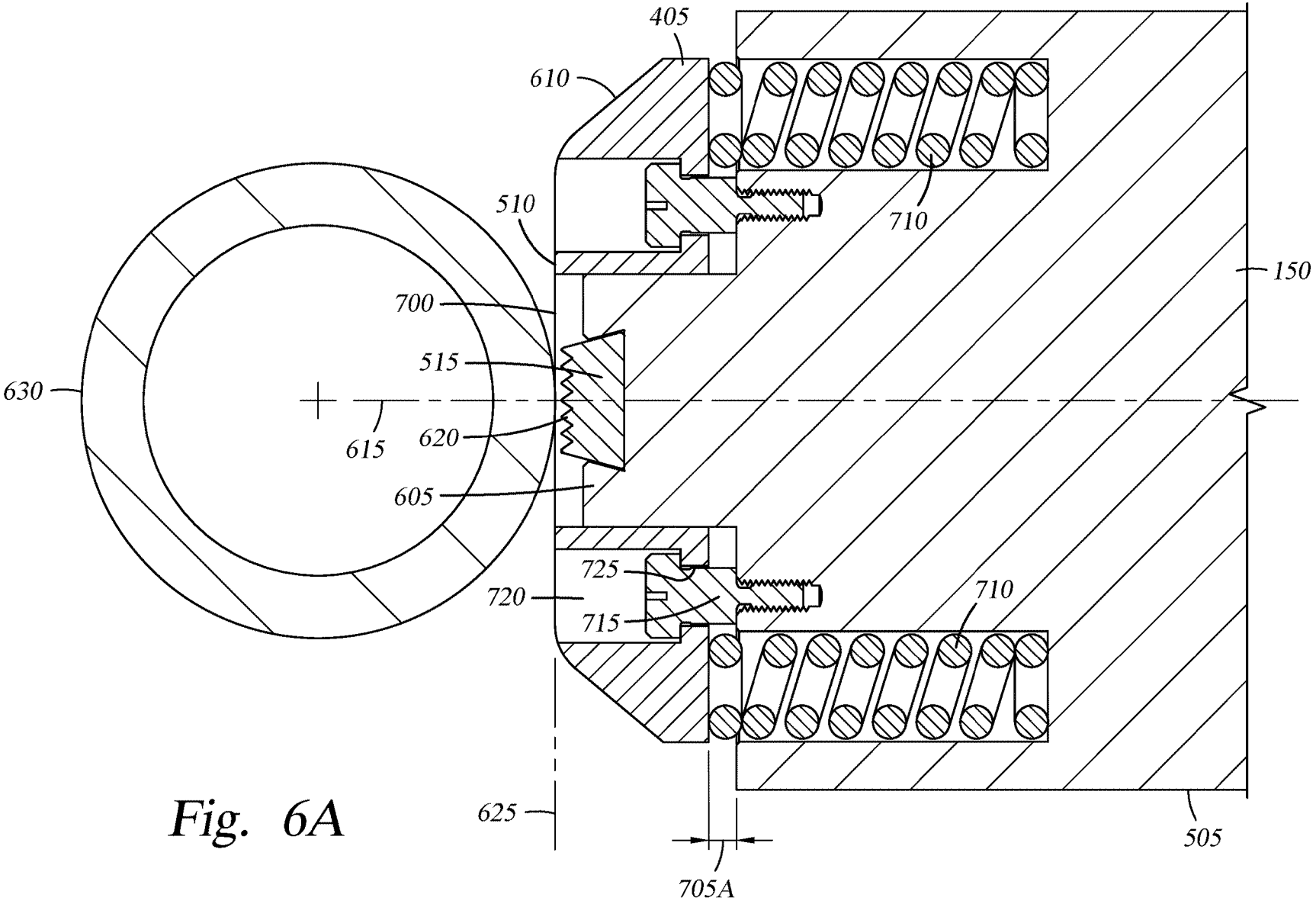
FIGS. 6A and 6B are enlarged sectional views of a portion of a gripper showing the first and second positions of a primary contact plate relative to the tubular.
Figure 6B:
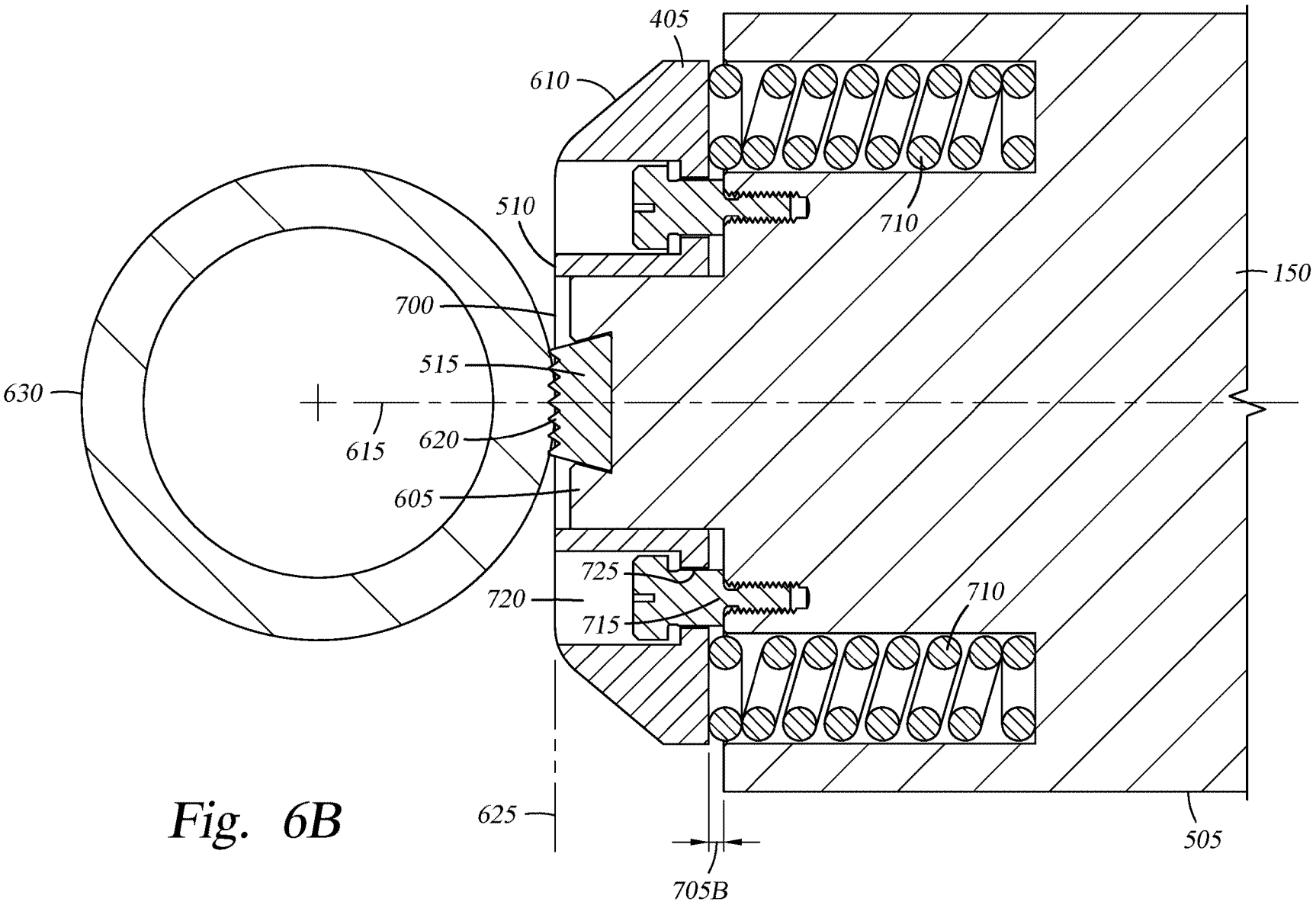

FIGS. 6A and 6B are enlarged sectional views of a portion of a gripper 150 showing the first and second positions of the primary contact plate 510 relative to the first tubular 630. In FIG. 6A, the gripping surface 620 of the die plate 515 is below the plane 625 of the primary contact plate 510. Thus, a surface 700 of the primary contact plate 510 contacts an outer surface of the tubular 630 prior to the gripping surface 620 of the die plate 515. In this first position, the primary contact plate 510 may be spaced from the piston 505 a first distance 705A.

A biasing member 710, such as a spring, may be utilized to bias the primary contact plate 510 toward the first tubular 630. During extension of the gripper 150, the first tubular 630 is contacted first by the primary contact plate 510, which allows movement of the first tubular 630 along the surface 700 prior to gripping by the gripping surface 620 of the die plate 515. Thus, if the first tubular 630 is not centered relative to the longitudinal axis 615 as shown in FIG. 6A, the first tubular 630 may slide along the surface 700 towards the longitudinal axis 615 of the gripper 150. When contacted by other grippers 150 of the lower clamp assembly 140, the first tubular 630 may be contacted by the respective primary contact plates 510 and move toward the respective longitudinal axes 615 as shown in FIG. 5A.

FIG. 6B shows the primary contact plate 510 in a second position such that the gripping surface 620 of the die plate 515 extends beyond the plane 625. Once the first tubular 630 is centered, continued movement of the grip head 405 along the longitudinal axis 615 overcomes the bias force of the biasing member 710 and compresses the biasing member 710 such that the gripping surface 620 of the die plate 515 is urged into engagement with the first tubular 630 to grip the first tubular 630. The die plate 515 may be hardened steel with a roughened gripping surface configured to grip the tubular 630.

In this position, the primary contact plate 510 may be spaced a second distance 705B from the piston 505, which is less than the first distance 705A. Thus, the gripping surface 620 of the die plate 515 may bite into the surface of the first tubular 630 and grip the first tubular 630. Indexing pins 715 may fasten the primary contact plate 510 to the piston 505. The primary contact plate 510 may include recesses 720 where the indexing pins 715 may be positioned. The primary contact plate 510 may include openings 725 where a portion of the indexing pins 715 may extend through.

The wrench assembly 110 having grip heads 405 as described herein help center the first tubular 630 within the wrench assembly 110 before the die plate 515 engages the first tubular 630. The centering of the first tubular 630 aligns the center axis of the first tubular 630 with the center axis of the wrench assembly 110. Since the center axis of the wrench assembly 110 is the axis about which maximum torque is applied, then wrench assembly 110 effectively ensures that the maximum amount torque is being applied to the first tubular 630 to make up or break out a threaded connection.

In one embodiment, each of the grippers 150 of the lower clamp assembly 140 are optionally coupled to a flow divider 400 as shown in FIG. 4. The flow divider 400 is configured to actuate all of the grippers 150 at substantially the same time and/or extend the grippers 150 at substantially the same rate so that grip heads 405 (only one is shown in FIG. 4) contact the first tubular 630 at substantially the same time. In particular, the flow divider 400 controls (such as by equally dividing) the amount and/or flow rate of fluid supplied to each gripper 150 via flow lines 410 to move the grippers 150 toward the first tubular 630 to center the first tubular 630 within the wrench assembly 110.

While the foregoing is directed to embodiments of the disclosure, other and further embodiments of the disclosure thus may be devised without departing from the basic scope thereof, and the scope thereof is determined by the claims that follow.

The invention claimed is:

1. A wrench assembly, comprising;

an upper clamp assembly; and a lower clamp assembly coupled to the upper clamp assembly, wherein the lower clamp assembly comprises a plurality of grippers each having a grip head configured to grip a tubular, and each grip head comprises:

a die plate surrounded by a primary contact plate, the die plate being disposed in a central cavity of the primary contact plate, the central cavity being formed at least partially in a surface of the primary contact plate, wherein the surface of the primary contact plate is configured to contact the tubular prior to a gripping surface of the die plate contacting the tubular.

2. The wrench assembly of claim 1, wherein the primary contact plate has rounded corners configured to center the tubular within the wrench assembly.

3. The wrench assembly of claim 2, wherein the primary contact plate is biased by a biasing member toward the tubular.

4. The wrench assembly of claim 3, wherein the gripping surface of the die plate is disposed on one side of a plane of the primary contact plate during an initial contact of the surface of the primary contact plate with the tubular.

5. The wrench assembly of claim 4, wherein the biasing member is configured to compress such that the gripping surface of the die plate extends beyond the plane of the primary contact plate during gripping of the tubular.

6. The wrench assembly of claim 5, wherein the rounded corners are configured to push the tubular toward a center axis of the wrench assembly before the die plate engages the tubular.

7. The wrench assembly of claim 6, wherein the rounded corners comprise a bevel, a radius, or a chamfer.

8. The wrench assembly of claim 7, wherein the upper clamp assembly is configured to grip and rotate a second tubular relative to the tubular gripped by the lower clamp assembly to make-up or break-out a threaded connection between the second tubular and the tubular gripped by the lower clamp assembly.

9. The wrench assembly of claim 3, wherein the biasing member comprises a spring.

10. The wrench assembly of claim 1, wherein the primary contact plate includes a plane, and the die plate is movable between a first position and a second position, wherein the gripping surface is on one side of the plane in the first position, and the gripping surface is on another side of the plane in the second position.

11. The wrench assembly of claim 10, wherein the surface of the primary contact plate is disposed at least partially in the plane.

12. A wrench assembly, comprising;

an upper clamp assembly; and a lower clamp assembly coupled to the upper clamp assembly, wherein the lower clamp assembly comprises a plurality of grippers configured to grip a tubular, each gripper comprising:

a primary contact plate comprising a central cavity, and a die plate disposed in the central cavity of the primary contact plate, the die plate being movable relative to the primary contact plate between a first position and a second position, and the die plate comprising a gripping surface that is spaced from the tubular in the first position and is engaged with the tubular in the second position.

13. The wrench assembly of claim 12, wherein the primary contact plate includes a plane, and the gripping surface of the die plate is on one side of the plane in the first position, and the gripping surface is on another side of the plane in the second position.

14. The wrench assembly of claim 12, wherein the primary contact plate has rounded corners configured to center the tubular within the wrench assembly.

15. The wrench assembly of claim 14, wherein the primary contact plate is biased by a biasing member toward the tubular.

16. The wrench assembly of claim 15, wherein the gripping surface of the die plate is disposed on one side of a plane of the primary contact plate during an initial contact with the tubular.

17. The wrench assembly of claim 16, wherein the biasing member is configured to compress such that the gripping surface extends beyond the plane of the primary contact plate during gripping of the tubular.

18. The wrench assembly of claim 17, wherein the rounded corners are configured to push the tubular toward a center axis of the wrench assembly before the die plate engages the tubular.

19. The wrench assembly of claim 18, wherein the rounded corners comprise a bevel, a radius, or a chamfer.

20. The wrench assembly of claim 19, wherein the upper clamp assembly is configured to grip and rotate a second tubular relative to the tubular gripped by the lower clamp assembly to make-up or break-out a threaded connection between the second tubular and the tubular gripped by the lower clamp assembly.

21. The wrench assembly of claim 20, wherein the biasing member comprises a spring.

* * * * *